US010259615B2

(12) United States Patent
Sale et al.

(10) Patent No.: US 10,259,615 B2
(45) Date of Patent: Apr. 16, 2019

(54) BAG HAVING BOTTOM HANDLE FORMED THROUGH AN AREA OF FOLDED AND HEAT-WELDED LAYERS

(75) Inventors: Mark D. Sale, Kailua-Kona, HI (US); Tara J. Saville, Kailua-Kona, HI (US); Jay B. Paulson, Waikoloa, HI (US)

(73) Assignee: Baldwin, Barlow & Baring Inc., Kailua Kona, HI (US)

( * ) Notice: Subject to any disclaimer, the term of this patent is extended or adjusted under 35 U.S.C. 154(b) by 224 days.

(21) Appl. No.: 13/601,924

(22) Filed: Aug. 31, 2012

(65) Prior Publication Data

US 2012/0328217 A1 Dec. 27, 2012

Related U.S. Application Data

(63) Continuation-in-part of application No. 13/176,737, filed on Jul. 5, 2011, now Pat. No. 8,790,009.

(60) Provisional application No. 61/530,709, filed on Sep. 2, 2011, provisional application No. 61/659,899, filed on Jun. 14, 2012, provisional application No. 61/361,788, filed on Jul. 6, 2010.

(51) Int. Cl.

| | |
|---|---|
| ***B65D 33/00*** | (2006.01) |
| ***B65D 33/06*** | (2006.01) |
| ***B65D 33/01*** | (2006.01) |
| ***B65D 30/08*** | (2006.01) |
| ***B65D 33/08*** | (2006.01) |
| ***B65D 33/16*** | (2006.01) |
| ***B65D 33/28*** | (2006.01) |
| ***B65F 1/00*** | (2006.01) |
| ***B65F 1/14*** | (2006.01) |
| *B31B 160/10* | (2017.01) |
| *B31B 155/00* | (2017.01) |
| *B31B 70/14* | (2017.01) |
| *B31B 70/86* | (2017.01) |

(52) U.S. Cl.

CPC ..... *B65D 33/01* (2013.01); *B65D 31/04* (2013.01); *B65D 33/08* (2013.01); *B65D 33/1608* (2013.01); *B65D 33/28* (2013.01); *B65F 1/0006* (2013.01); *B65F 1/1468* (2013.01); *B31B 70/148* (2017.08); *B31B 70/872* (2017.08); *B31B 70/874* (2017.08); *B31B 2155/00* (2017.08); *B31B 2160/10* (2017.08); *B65D 33/001* (2013.01); *B65D 33/002* (2013.01)

(58) Field of Classification Search

CPC .... B65D 33/001; B65D 33/002; B65D 33/06; B65D 33/065; B65D 33/08; B65D 33/14

USPC ..... 383/6, 7, 9, 10, 16, 17, 37

See application file for complete search history.

(56) References Cited

U.S. PATENT DOCUMENTS 43,567 A * 7/1864 Campbell ..... 383/10
3,249,285 A * 5/1966 Dollheimer et al. ..... 383/9
(Continued)

FOREIGN PATENT DOCUMENTS

JP 2000142713 5/2000
JP 2001106301 4/2001
WO WO 2006135562 A2 * 12/2006 ..... B65F 1/00

*Primary Examiner* — Jes F Pascua
*Assistant Examiner* — Nina K Attel
(74) *Attorney, Agent, or Firm* — Sean D. Burdick

(57) ABSTRACT

A bag including a containment portion having an opening to receive items, a bag seal at an end of the bag opposite the opening, a handle seal at an end of the containment portion opposite the opening, the handle seal located between the bag seal and the opening, and a handle in a handle body formed between the handle seal and the bag seal.

5 Claims, 11 Drawing Sheets

(56) References Cited

U.S. PATENT DOCUMENTS

| | | | | | |
|---|---|---|---|---|---|
| 3,349,991 | A | * | 10/1967 | Kessler | B65D 31/16 383/120 |
| D235,739 | S | * | 7/1975 | Christensen | D9/704 |
| 5,209,573 | A | * | 5/1993 | Freeman | 383/109 |
| 5,573,489 | A | * | 11/1996 | Letendre et al. | 493/194 |
| 5,782,562 | A | * | 7/1998 | Anspacher | 383/15 |
| 5,941,393 | A | * | 8/1999 | Wilfong, Jr. | B65B 43/14 206/554 |
| 6,206,569 | B1 | * | 3/2001 | Kraimer et al. | 383/109 |
| 6,957,915 | B2 | * | 10/2005 | Tankersley | 383/109 |
| 2003/0059130 | A1 | * | 3/2003 | Yoneyama et al. | 383/10 |
| 2005/0053313 | A1 | * | 3/2005 | Lucas et al. | 383/16 |
| 2005/0276521 | A1 | * | 12/2005 | Price | 383/10 |
| 2006/0042007 | A1 | * | 3/2006 | Kohn et al. | 5/114 |
| 2010/0054634 | A1 | * | 3/2010 | Runyon et al. | 383/10 |
| 2010/0142859 | A1 | * | 6/2010 | Cushman | 383/10 |
| 2010/0296754 | A1 | * | 11/2010 | Chiu | 383/10 |

* cited by examiner

BAG HAVING BOTTOM HANDLE FORMED THROUGH AN AREA OF FOLDED AND HEAT-WELDED LAYERS

RELATED APPLICATIONS

This application is a continuation in part of, and claims priority to, U.S. patent application Ser. No. 13/176,737, filed Jul. 5, 2011, now U.S. Pat. No. 8,790,009, which in turn claims priority to U.S. Provisional Patent Application 61/361,788, filed Jul. 6, 2010. In addition, this application claims priority to, and incorporates by reference, U.S. Provisional Patent Application 61/530,709, filed Sep. 2, 2011, and U.S. Provisional Patent Application 61/659,899, filed Jun. 14, 2012. This application is related to U.S. patent application Ser. No. 14/034,480, filed Sep. 23, 2013.

BACKGROUND

Overexertion back injuries rarely occur as a result of a single event or accident. The human spine typically undergoes weeks or months of heavy lifting and awkward work postures until some element of the back, including discs, vertebrae and muscles, gives out. Even for people who or not involved in day to day manual labor, injuries can result from just ordinary household tasks like taking out the trash, cleaning up the yard and discarding landscape waste, etc.

Trash bags are generally designed to have a sealed seam on the bottom and some sort of closure at the top. Closures include twist ties, drawstring handles, extensions on the top of the bag that can be tied—so-called "handle tie" bags, etc. Once closed, the user generally picks the bag up from the closure and puts it into a trash receptacle. This lifting of the waste bag from one point, generally out away from the body, is not ergonomic, and can cause injury or at the very least, fatigue.

In addition, in order to get a better grip on the bag a user may grab the body of the bag. If there is an unseen sharp object in the bag, the user runs the risk of injury by the unseen object when the user grabs the bag. Even if the user does not grab the body of the bag, the bag will typically dangle next to the user's legs as it is carried, and the user may be injured if the sharp object hits the user's leg.

Additionally, often the bag is not used anywhere near its full capacity because of concerns that the bag will rip or tear due to the poor distribution of weight. Users often cannot lift as much waste as they may desire because the awkwardness of the hanging bag prevents them from lifting more. This makes currently available fillable bags inefficient and not cost-effective.

This also applies to pre-filled or pre-packaged materials in bags. A materials supplier or manufacturer may package materials such as sand, concrete, potting soil, etc. in smaller bags to allow easier handling and movement. If there were a way to allow users to handle the material more easily, the suppliers could package the materials in larger amounts, reducing the number of bags needed per pound of material.

DETAILED DESCRIPTION OF THE EMBODIMENTS

Figure 1:
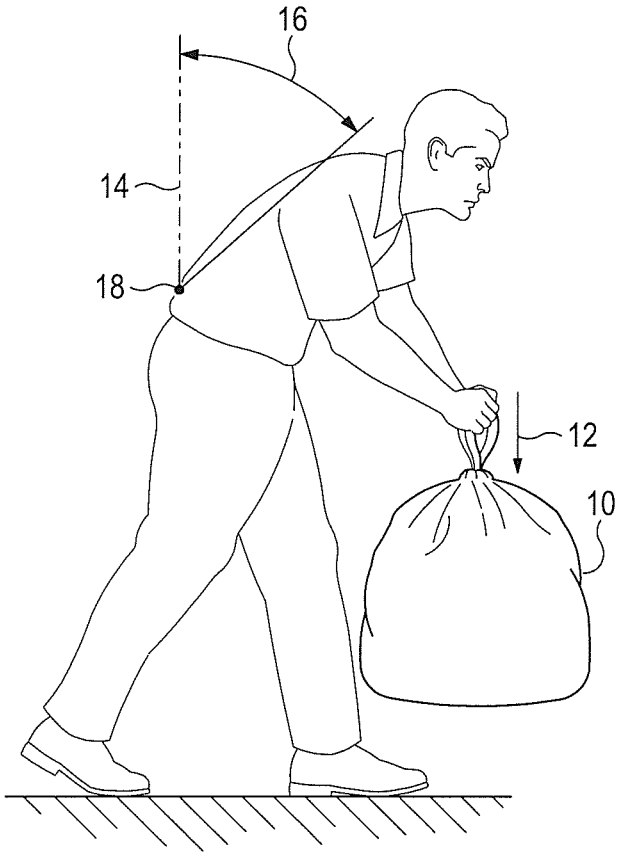
FIG. 1 shows an example of a typical trash bag use.

FIG. 1 shows an example of a user picking up a bag 10. The bag in this example is a handle tie trash bag. As can be seen, the load of the bag 10 hangs straight down from the user's arms 12. This causes the user to lean out a distance 16 from vertical, shown by line 14. This forms a fulcrum point 18 in the user's back, applying stress and strain to the back, increasing the likelihood of injury.

Figure 2:
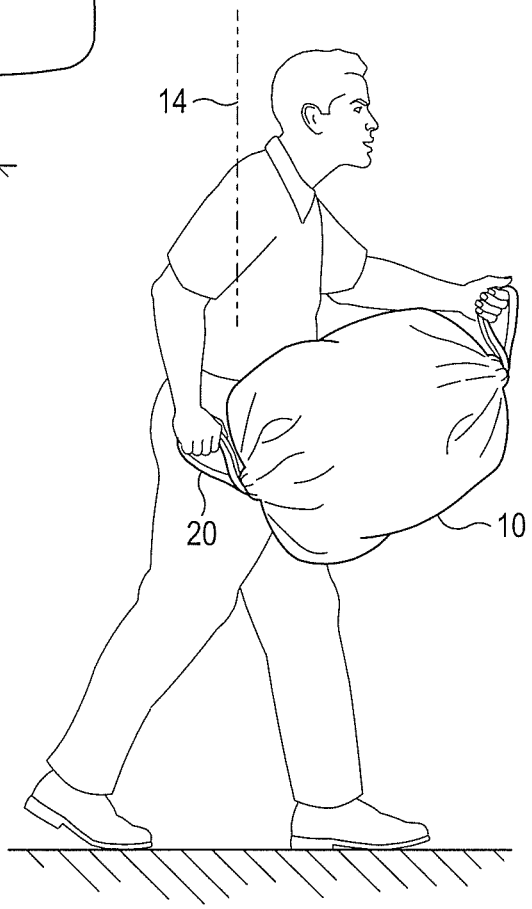
FIG. 2 shows an embodiment of a bag having a second handle to promote efficient, ergonomic use.

FIG. 2 shows an example of a user picking up a bag 10 using a bottom handle flap 20. While the user is shown bent slightly from the vertical 14, it is much more likely for the user to be able to straighten fully because of the ability to spread the arms and distribute the load across the torso evenly. Also, even with the bend from vertical, it is far easier for the user to keep the back straight with no fulcrum point that focuses the stress and strain of the load.

Figure 3:
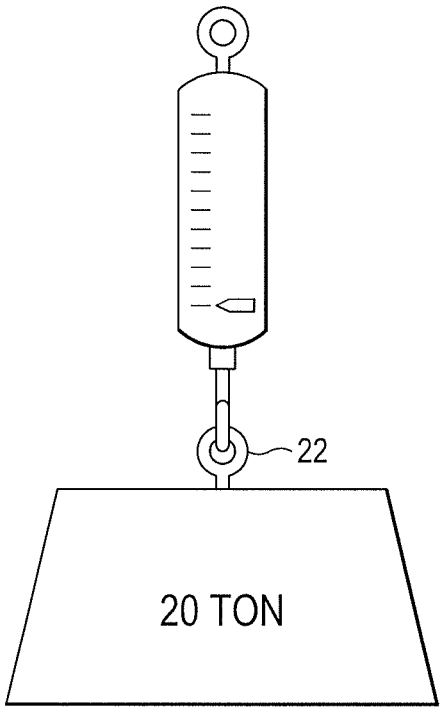
FIG. 3 shows a representation of weight distribution for a point load.
Figure 4:
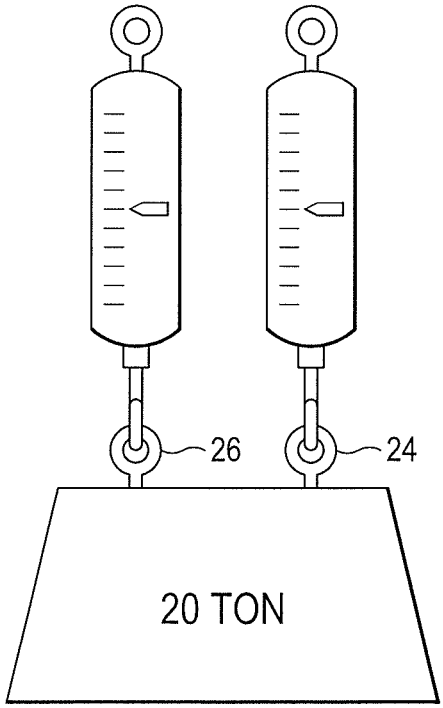
FIG. 4 shows a representation of weight distribution for a load distributed between two points.

FIG. 3 shows a single point of load 22 for a 20 ton weight. All of the force of the load is focused at the lifting point of the load 22. In contrast, FIG. 4 shows two points of load 24 and 26. The load will generally be distributed evenly between the two points. Further two points of load allow more freedom of movement and the ability to adjust the points to more evenly distribute the load. For a non-homogenous load, such as might occur in a trash bag where the contents may be a mix of items with different densities such as grass clippings and leaves, the ability to adjust the balance between two points of load provides an advantage. Having two handles allows distribution of the point load among two points.

The term bag as used here means a container for holding any material that has three closed edges ie: left edge, right edge, bottom edge, two sides ie front and back panels and an open top with or without some type of closure, Alternatively, a bag may not have three distinct edges. For example, the bag may have a body formed from flattened tubular stock with a continuous curved edge, with an opening. The top handle would be at the opening, the bottom handle flap would be located on a portion of the curved seam typically, but not necessarily, at the bottom of the bag. Examples of a bag include bags of all sizes, including household 'kitchen' bags, 'outdoor' bags, contractor bags, made of plastic, fibrous materials, paper, cardboard, or even thin cloth, and material bags filled with such items as concrete, sand, potting soil, bark mulch, grains, compost, etc. The top handle may be formed from the side edges of the opening, separate from the opening, formed from the side panels of the bag, etc. It will be referred to as being adjacent to the opening.

Figure 5A:
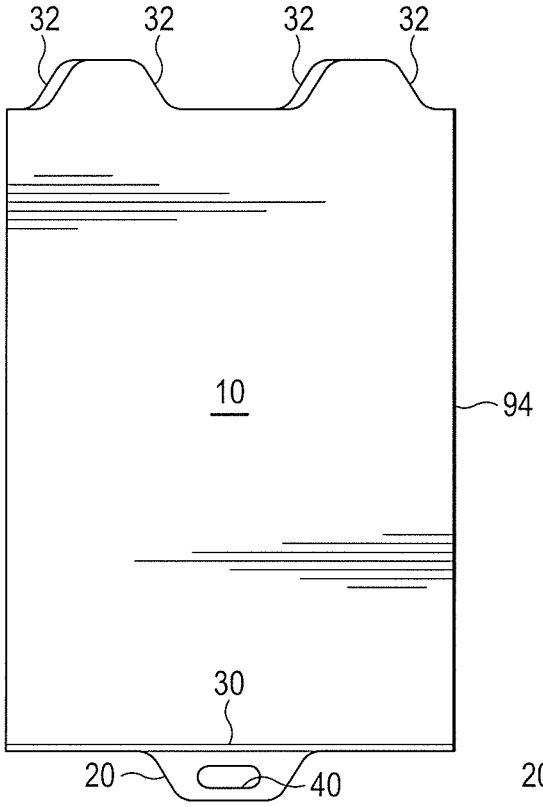
FIGS. 5A-D shows examples of differing bag handle and top shapes.
Figure 5B:
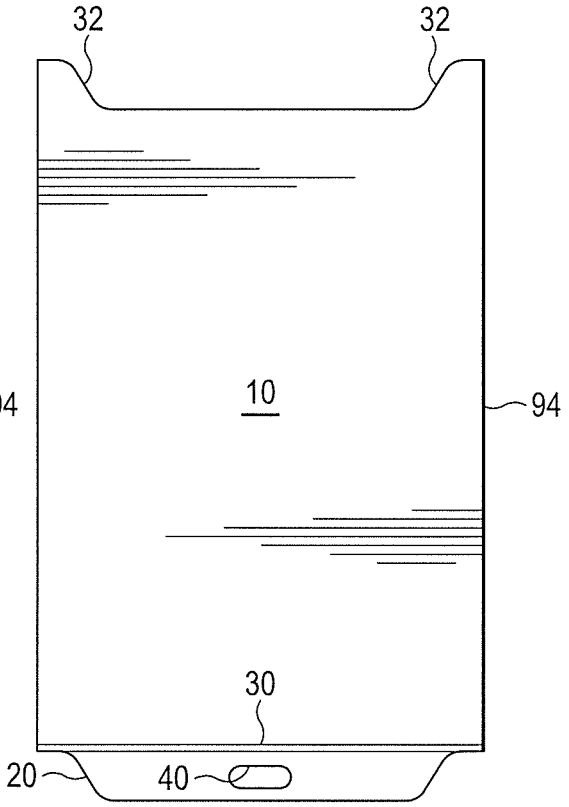

FIGS. 5A-D show embodiments of a bag body front-side and back-side panels 10, having top handle ties 32, handle flap 20 and sides/edges 94. The bottom handle flap 20 is arranged to be outside the sealed seam 30 in FIG. 5A, with a different relationship between the ties 32 and the bottom handle shown in 5B. FIG. 5B also shows a different configuration of the handle. The handle flap could be one of many shapes, sizes or types. The handle flap could be either an extension of the body side panels 10, or a separate piece of material, of the same material as the body of the bag or of a different type, joined, welded or bonded in any fashion to the body.

Figure 5C:
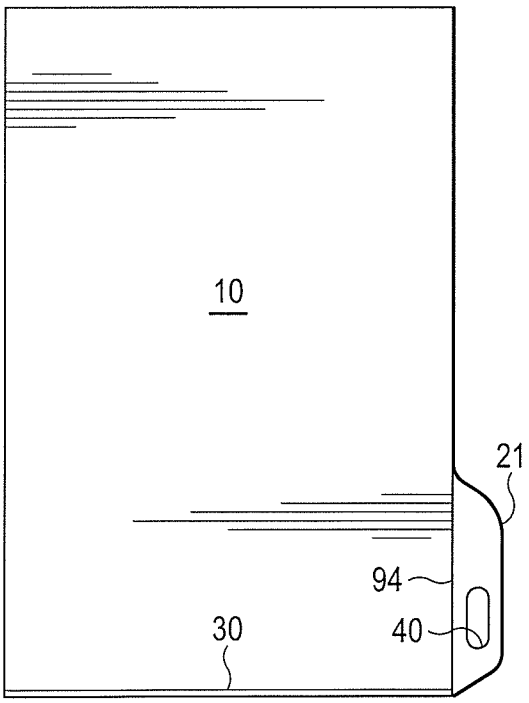
Figure 5D:
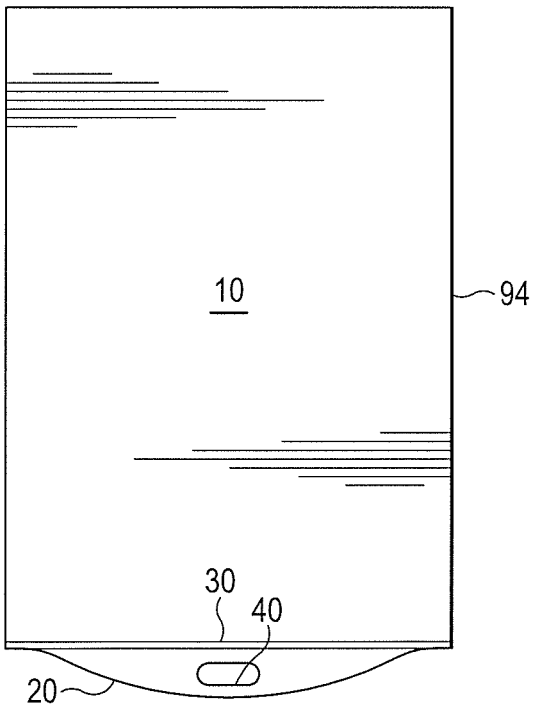

The handle flap could employ various methods of construction and is not limited in shape, size, form or location. For example the handle flap may either be joined around the perimeter as a result of many manufacture methods such as welded, fused, bonded, fused completely together by whatever method, or left unjoined and open. These options will be described in further detail in FIGS. 7, 8 and 14. The handle flap could be located in any position around the perimeter of the bag as seen on the side of the bag 21. Similarly the bag itself may not be a handle tie bag, such as shown in FIGS. 5C and 5D.

Figure 6B:
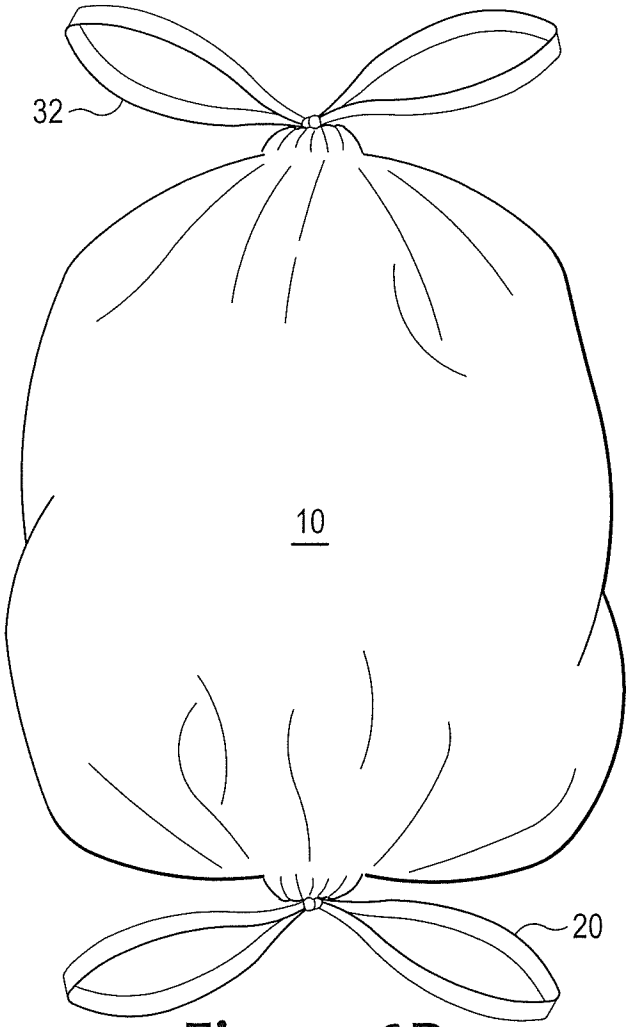
FIGS. 6A-B show an embodiment of a draw-string bag having a second draw string handle.
Figure 6A:
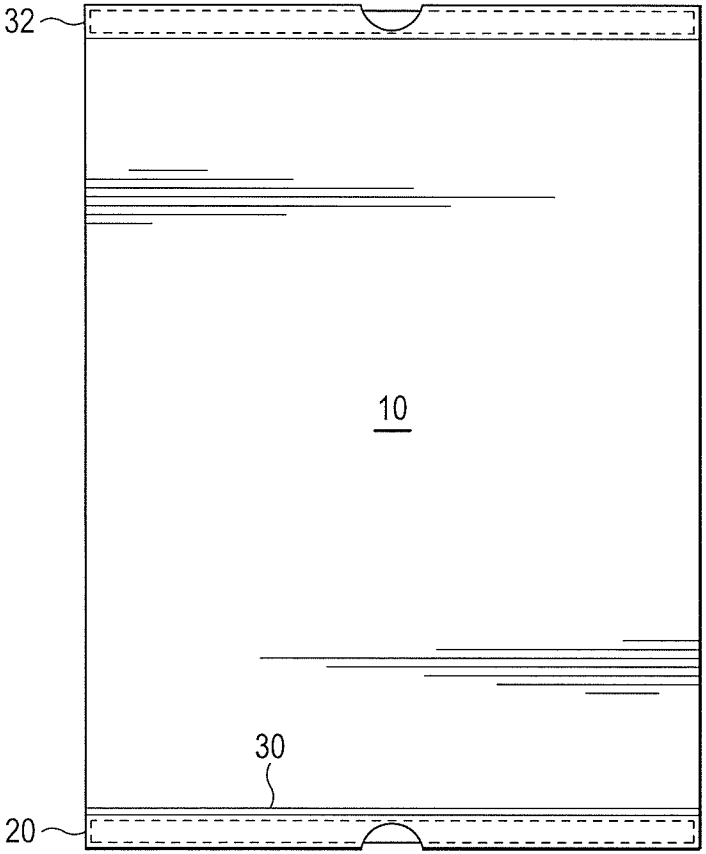

One should also note that the examples in FIGS. 6A-B show a bottom handle that is the same as the top handle, no limitation to this particular arrangement is intended, nor should any be implied. Further, the bottom handle may not actually be on the 'bottom' of this bag, it may be located on an edge or side portion of the bag.

In FIGS. 6A-B, the bag is filled from the open, also referred to here as the 'top' end of the bag at handle 32. Once filled as far as desired, the user would draw the strings in the top handle 32. The bottom handle 20, being also of the drawstring variety, would be drawn to allow the user to grasp the straps of the handle similar to the manner in which the top handle 32 is grasped, shown in FIG. 6B.

Figure 7:
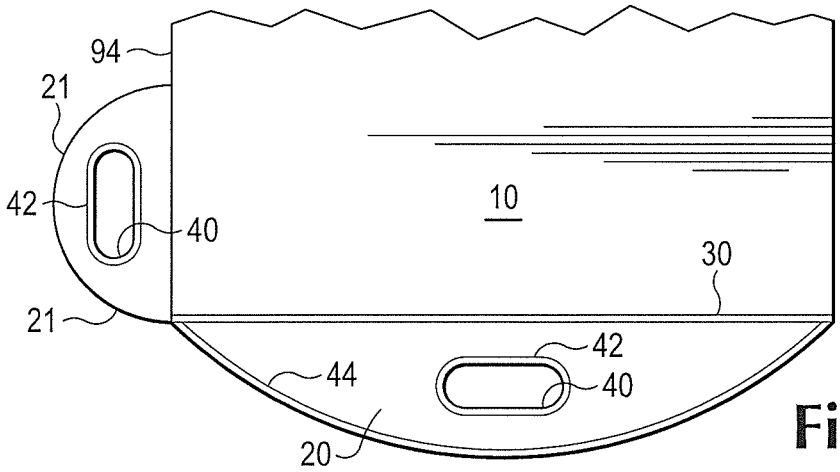
FIGS. 7-8 show differing embodiments of a second handle for a hole handle bag.
Figure 8:
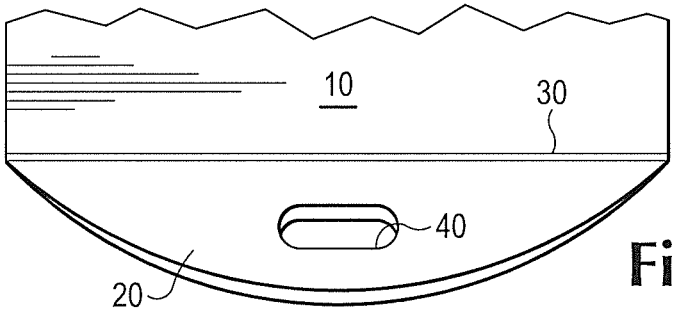

As mentioned above, the handle could be one of many types. FIGS. 7-8 show an example of a handle that is formed in the handle flap 20, referred to here as a 'hole handle' 40. In FIG. 7, two different locations for the handle are shown, but in one embodiment there could be three handles, the top handle, a bottom and a side handle, giving the user two options for lifting. The flap portion of the hole handle 40 could be an extension of the bag 10, which will be discussed in further detail with regard to manufacture below. When the bag is filled, as shown in FIG. 8, the user can grasp the hole handle 40 at the bottom of the bag to lift it more easily. Note that in FIG. 8, one can see that the handle is formed from extensions of both front and back side panels 10 of the bag, although the handle could be a single panel of material.

The bottom handle configuration may also be adjusted in size, shape, location to facilitate other uses. Ie the handle could also be located on the edge of the bag, as shown in FIG. 5 and FIG. 7. This side handle 21 would attach to the edge of the bag 94, instead of the way the handle flaps 20 attach or extend at the bottom sealed seam 30 of the bag. In addition, the handle flap and handle hole could be formed in many different ways. For example, the handle hole 40 could have the handle flaps joined, such as those shown in FIG. 7. Alternatively, as discussed below in FIG. 14 a seam 44 could seal just the perimeter of the handle flaps, and similarly just the perimeter of the hole 42, or the entire surface of the handle flaps could be bonded or sealed in any form together 46. Another example could have bonding, reinforcing or strengthening material between the flaps and then sealed.

Figure 9:
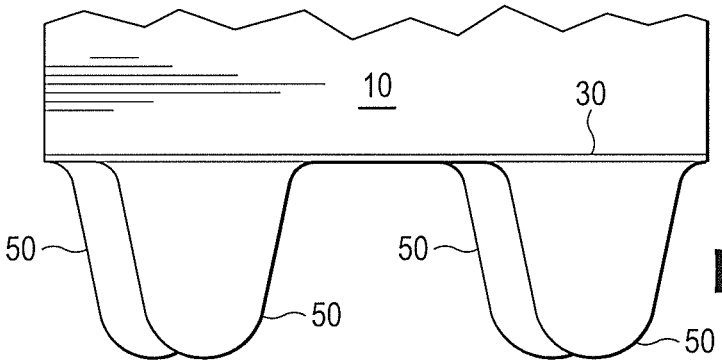
FIGS. 9-10 show an embodiment of a second handle for a handle-tie bag and drawstring bag.
Figure 10:
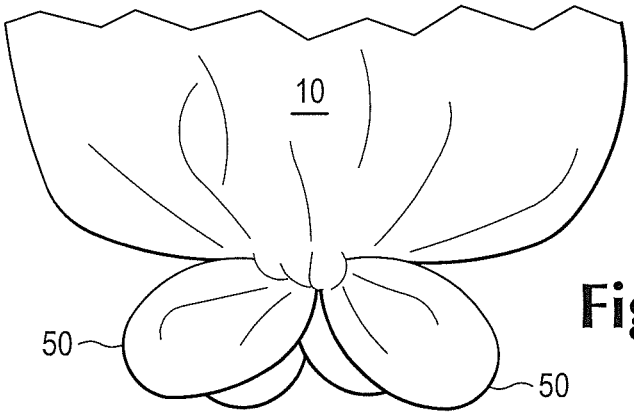

In yet another variation, FIGS. 9 and 10 shows examples of a handle-tie bag. A 'handle-tie' bag is one that has extensions, usually scalloped or otherwise curved into segments that can be tied to close the top of the bag. The bottom of the bag 10 would also have handle formed from the ties 50. When the bag is filled, shown in FIG. 10, the lower handles would be tied to allow the user to grasp them for transport. Another possible handle configuration is a perforated handle tie, where at least a portion of the handle is separated from the body of the bag by tearing along a perforation, while a portion of the handle typically remains attached to the body portion.

Other variations and modifications within the scope of the embodiments may exist. For example, the length of the handle could be adjusted to accommodate it acting as a protective layer if the bag where to be dragged over rough terrain.

Similarly, the bag may not only be used as a disposable or reusable bag that is filled by the user. Manufacturers and packagers of bulk materials, such as fertilizer, bark mulch, potting soil, sand, concrete, rice, wheat, corn, livestock feed, etc., could package their materials in bags that have a handle on either end. This would allow for more efficient and ergonomic handling of the materials by both warehouse workers and users and possibly reduce work-related injuries. The second handle may also assist in emptying the prepackaged materials from the bag, making it easier to distribute the materials more evenly or to reach less accessible areas. In this instance, the "opening" would be the end of the bag designed to be opened, such as with a tear off strip or other mechanism that allows the bag to be opened.

Figure 11:
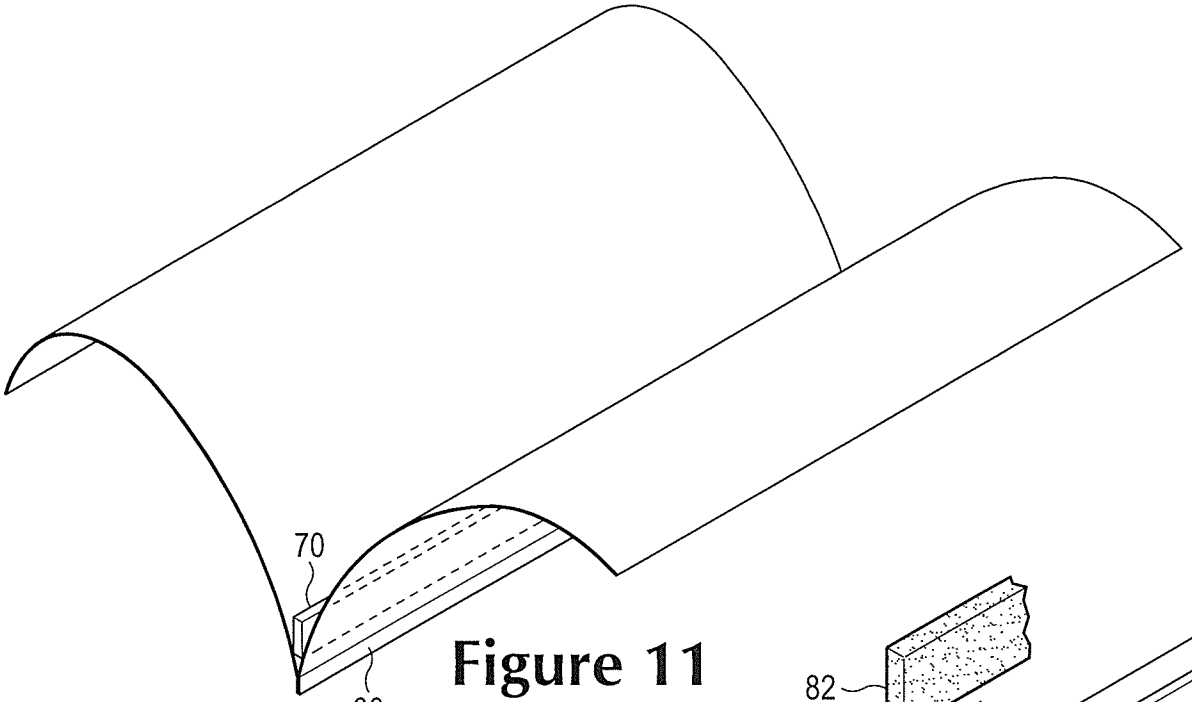
FIG. 11 shows an embodiment of a bag having an absorbent material adjacent to the bottom sealed seam.

In addition, the bag could have an absorbent strip or liner to absorb some of the accumulated fluid that may be in the material content stored or placed in the bag. As shown in FIG. 11, the bottom seal of the bag 30 by the second handle may also hold in place an absorbent strip 70. In the event of a bag rupture, the strip would have absorbed at least some of the fluid in the contents of the bag reducing the amount of fluid that would leak out of the bag.

Figure 12:
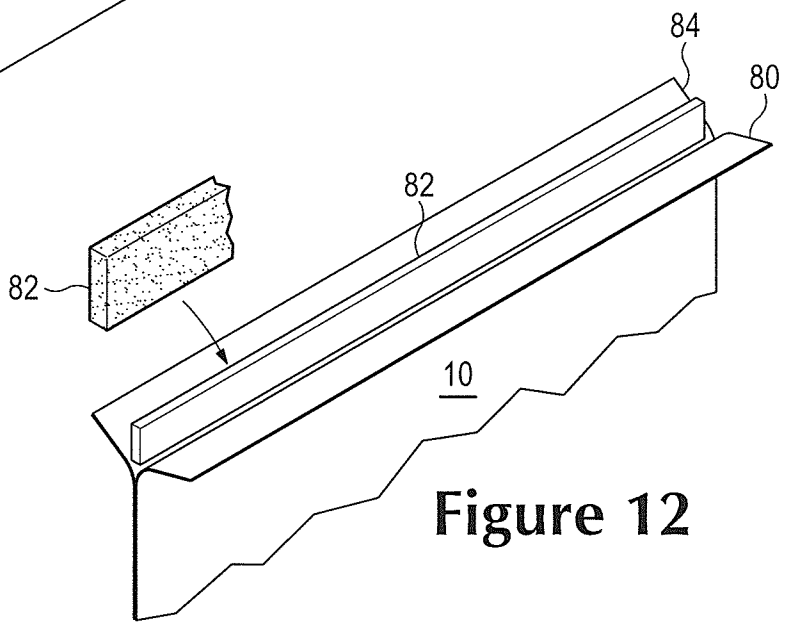
FIG. 12 shows an embodiment of a bag having an absorbent material or liner bonded between layers of the bag material.

For uses having more liquid involvement, the bag could actually be constructed having a ply system, in FIG. 12 an absorbent liner 82 is sandwiched between two plies of plastic 80 and 84. In the event of the inner ply being ruptured, the absorbent liner would absorb more of the fluids as well as acting as a more robust mechanical structure to stop further rupturing of the bag.

Typically, bags are formed from a tubular roll of stock material. The stock is laid flat, then stamped, cut or otherwise formed from the roll. The handles could be formed in the bottoms of the bags as part of the step of cutting and sealing the bottoms of the bag from the stock. As mentioned above, this would probably be fairly straightforward for the hole handle and handle tie bags.

However, one could easily see that with some slight adjustments, the drawstring bag process could easily be adapted. By leaving an extension of the bag past the bottom sealed seam, the process could add the drawstring feature to the bottom of the bag in the same manner as the top. As mentioned above, the size of the bag would not change; the flap would be made by using a longer run of the plastic stock than would be used for a standard sized bag. The position of the bag end would be the same relative to the top of the bag; the handle would be cut or stamped from an additional length of the stock material. After forming the handle, the stock would typically be cut straight to form the top of the next bag from the stock.

Figure 13:
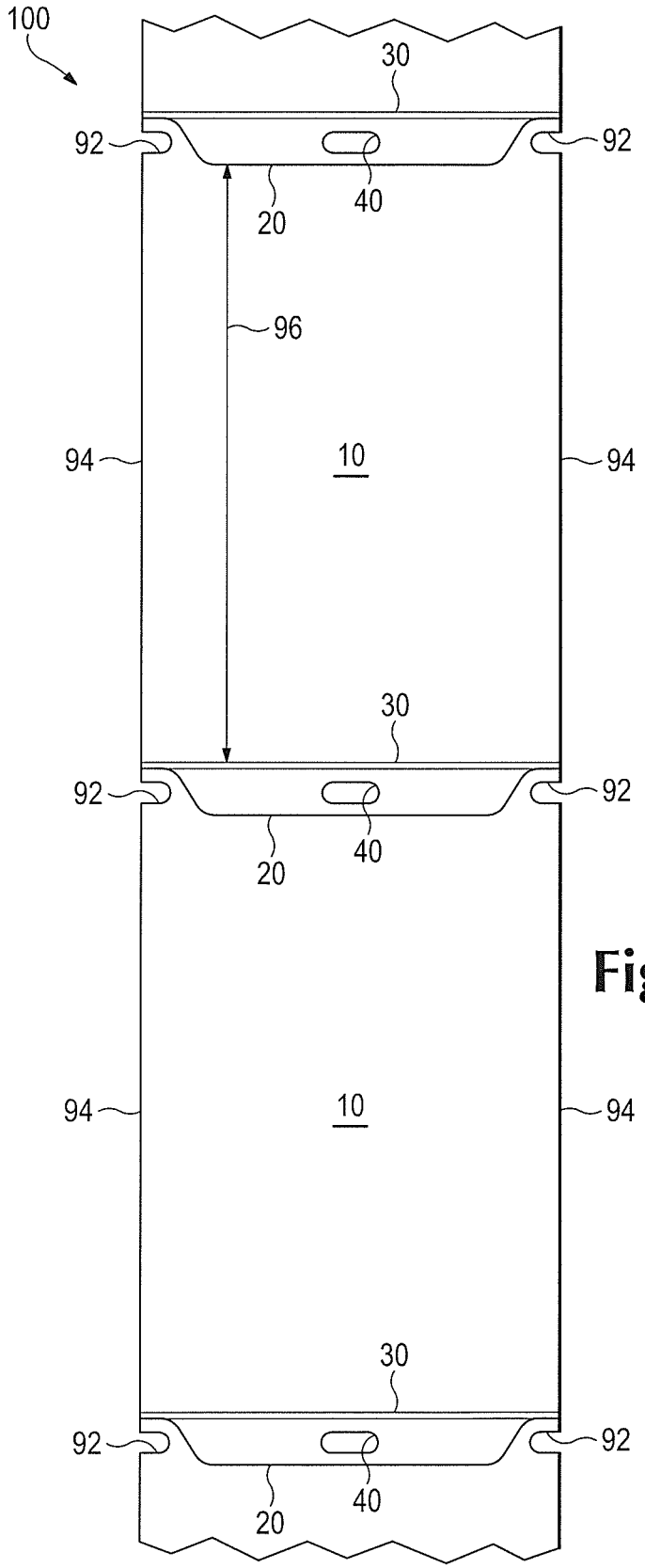
FIG. 13 shows an embodiment of manufacturing bags.

As discussed above, manufacture of the bags would more than likely use rolled or tubular stock. FIG. 13 shows an example of such stock adapted to produce bags with two handles. The stock 100 would be stamped, cut or otherwise perforated to form the individual bag outlines from the stock, such as bag 10. The sides/edges such as 94 of the bag would be formed because of the nature of the tubular stock. The bottom seam 30 would be welded or stamped for containment.

Figure 14:
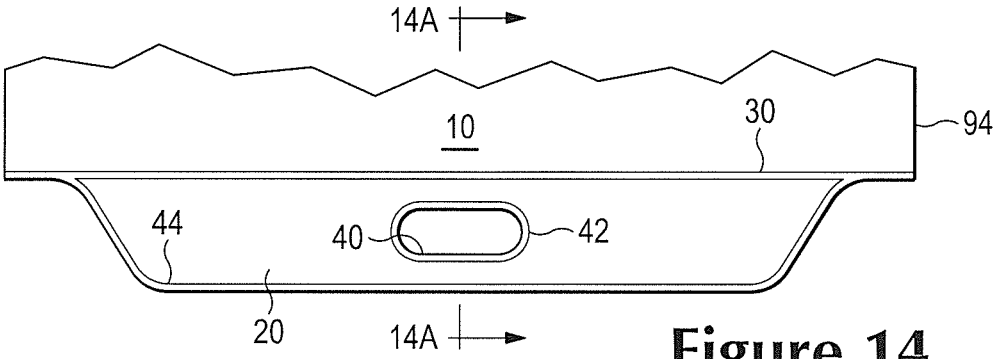
FIGS. 14-14B show an embodiment of a cross section of a bag detailing the handle and body.
Figure 14A:
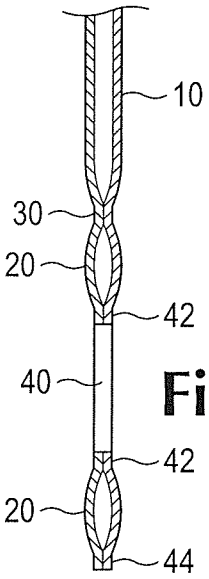
Figure 14B:
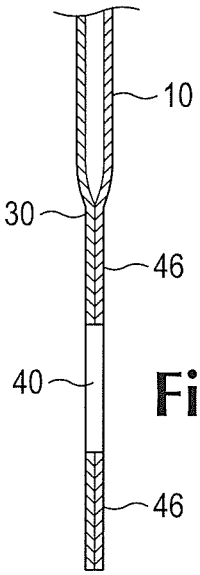
Figure 15:
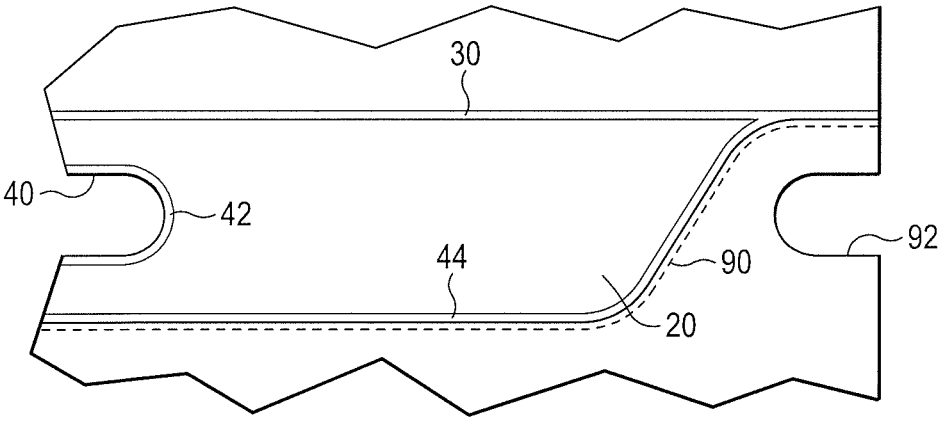
FIG. 15 shows the manufacturing seam detail of the simultaneous cut, weld, and perforation process.

FIG. 15 envisions a single manufacturing step in which all cuts, welds, and perforations are achieved at one time. This will increase CPM rates and lessen production cost making the product more viable in the market place. The lines 90 could be cut to produce individual units or perforated to package the bags as a roll. Optional upper hole handles 92 could be cut or stamped, but would not be welded together allowing the bag to be opened at the top. In FIG. 14 the shape at the mouth and bottom handle would be in addition to standard or typical bag sizes, leaving the volume/capacity of the bags unchanged. However, one could alter that configuration and remain within the scope of the embodiments described here.

Figure 16:
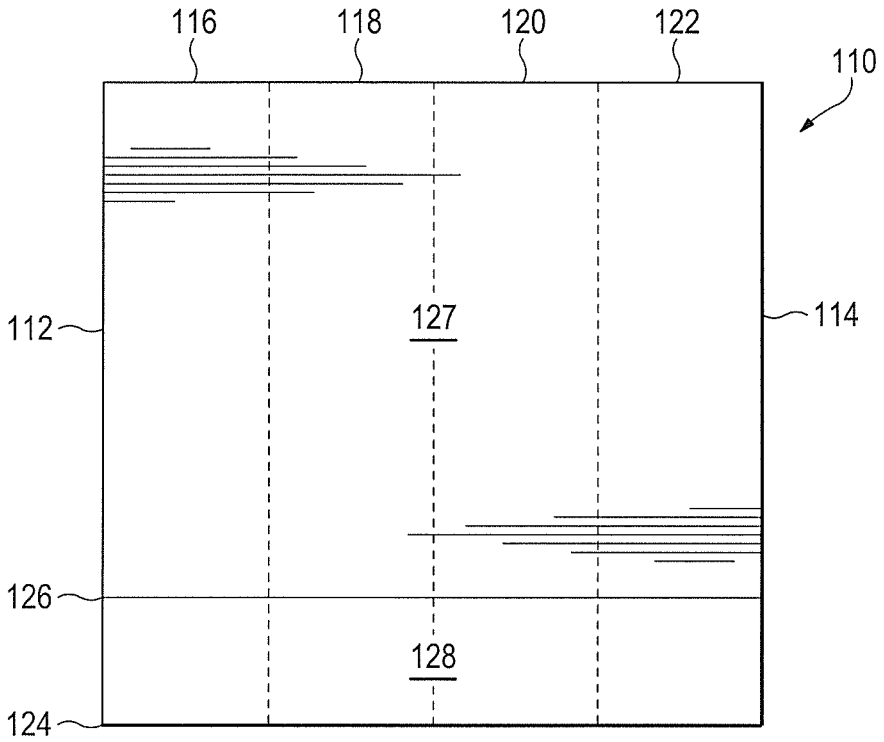
FIG. 16 shows an embodiment of a bag having a containment portion and a handle portion and fold lines.

For example, as shown in FIG. 16, the bag 110 may have a handle portion 128 that is separated from the rest of the body, referred to as the containment portion 127, by a handle seam 126. The term 'body' of the bag will refer to the entire length of the bag, consisting of the containment portion and the handle portion or handle body 128. In the embodiment of FIG. 16, the bag may function in the same way, but the construction method may be completely different.

The lower sealed seam 124, also referred to as the bottom or body seal, may run across the full width of the bag body. Different methods may fold the bag into fractions of the width, such as halves, quarters, fifths, etc. and then seal the seam, creating a compartment type of bag base. As shown in FIG. 16, the bag has quarter width increments 116, 118, 120 and 122, with outer edges 112 and 114. In this embodiment, the additional handle may result from extending the body and then applying the seal several inches from the bottom of the containment portion. When the bag is loaded the additional handle protrudes out of the base of the containment portion on the base of the bag. This provides one example, several different methods may be used dependent on manufacturing technique and application.

Figure 17:
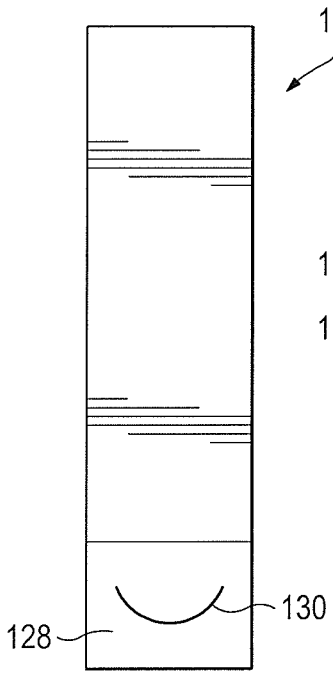
FIG. 17 shows an embodiment of a bag folded along fold lines to be one-quarter size folded.
Figure 18:
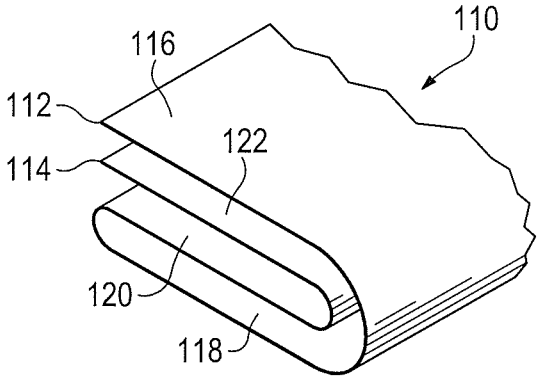
FIG. 18 shows an end view of a folded bag.

FIG. 17 shows an embodiment of the bag folded into quarters, with the handle 130 formed in the handle portion 128. The handle shown here consists of a semicircle slit. This may be accomplished by cut-sealing a 180 degree semicircle in the handle body. When the user places his or her hand through the semicircle, it creates that handle. This embodiment eliminates waste that may occur if the hole is punched through the material as oval or circular opening, and is easier to manufacture. In addition, the manufacturing process may stamp a perforated 180 degree or 360 degree hole in the handle body, allowing the user to push on the perforated area creating whichever size hole is most effective. In the case of the 360 degree hole, while the hole may take the form of a circle or an oval, it will be referred to here as a circular shape and will include other shapes than a perfect circle. These provide some examples, and are not intended to limit the variations in handle shape or formation in anyway, and no such limitation should be implied. FIG. 18 shows an end view of the folded bag of FIG. 17. As can be seen, the edges 112 and 114 of FIG. 16 end up adjacent to each other.

When manufacturing a bag with the handle in the body of the bag, the manufacturing process is slightly different than the methods previously discussed. Shown in FIG. 19, the open end 111 of the bag 110 may take any form, such as handle ties, drawstring, traditional tops to be closed with wire ties, etc.

The handle seal 126 is taken 'above' the bottom seal of the bag 124, in the containment portion of the bag 127 to form the handle body 128. While this may reduce the amount of space in the containment portion, it does have the advantage of using less material.

Figure 19:
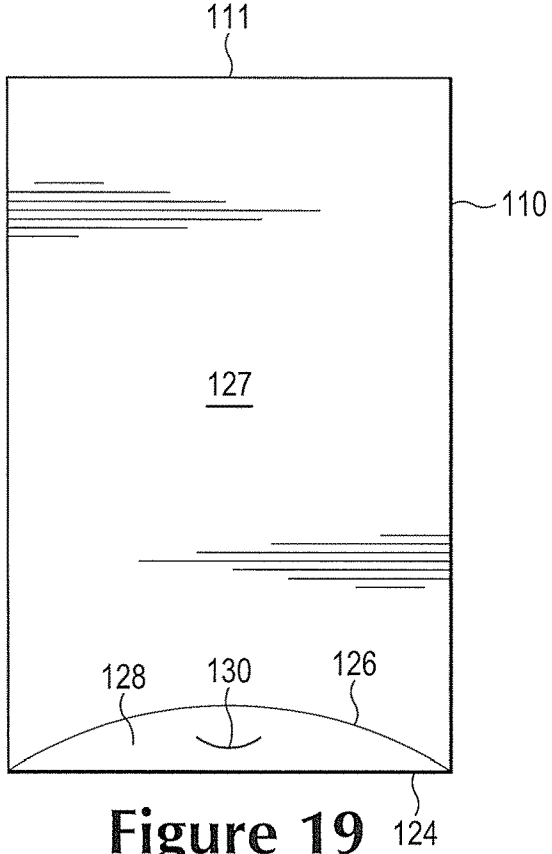

The handle seal may extend across the entire width of the stock as shown in FIG. 19. The handle 130 in this example consists of a curved slit that can be cut or perforated. The user merely inserts a hand into the slit or opens the perforations to form the handle.

Figure 20:
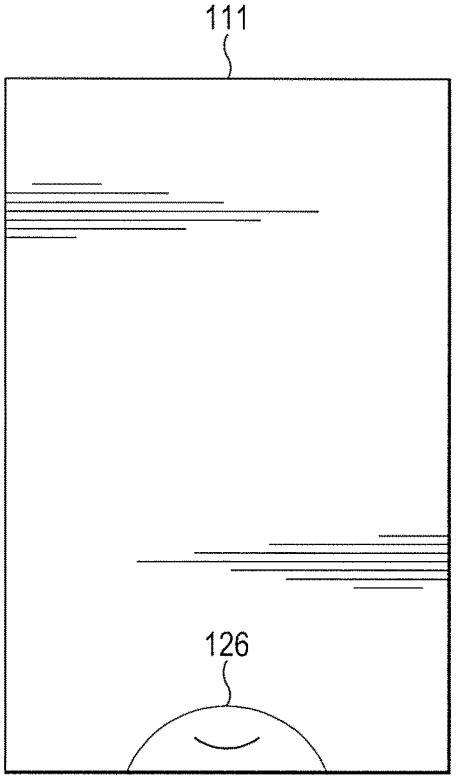
FIGS. 19-20 show embodiments of a handle portion as part of the body of the bag.

Alternatively, the handle seal 126 may only encompass a portion of the bottom seal, as shown in FIG. 20. This may allow the second handle body to be located to one side or the other of the containment portion. The position and width of the handle, the extent to which the handle body extends into the containment portion of the bag, as well as the placement of the handle on the handle body are all adaptable to any particular application and material and are considered within the scope of these embodiments.

Figure 21:
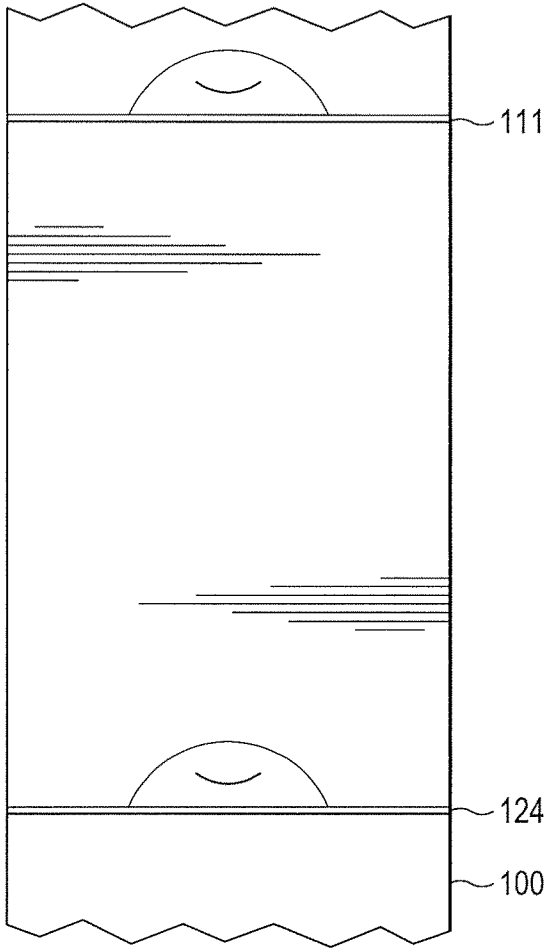
FIGS. 21-22 show embodiment of a bag having a handle portion as part of the body of the bag in stock form.
Figure 22:
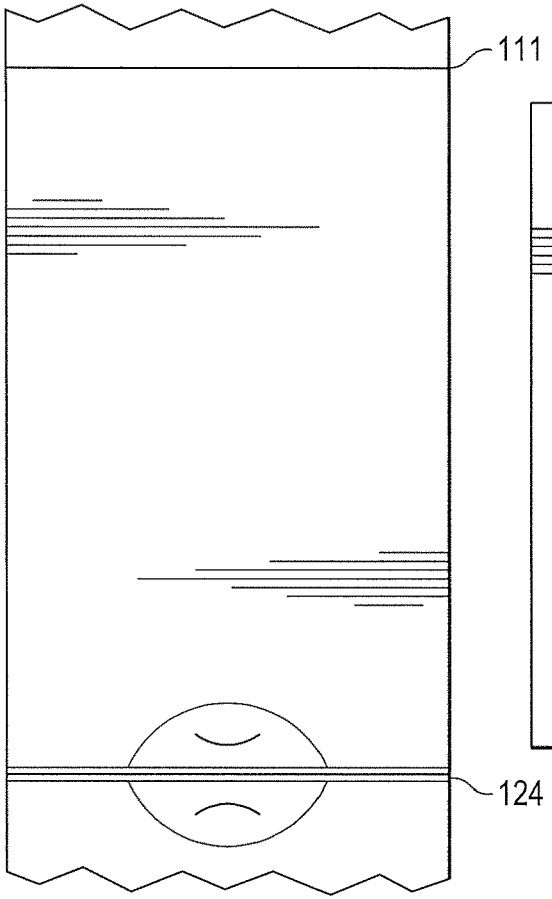

As shown in FIG. 21, during manufacture the bags may be positioned 'nose to tail' such that the open end of one bag is adjacent the bottom seal of the next bag. Alternatively, as shown in FIG. 22, the bottom portions could be adjacent each other between bags and the open ends adjacent the open ends of the next adjacent bags.

Figure 25:
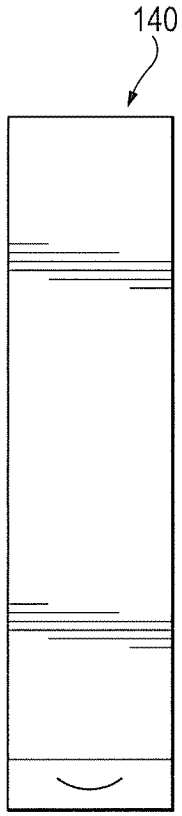
FIGS. 23-25 show alternative embodiments of handle portion of the bag.
Figure 24:
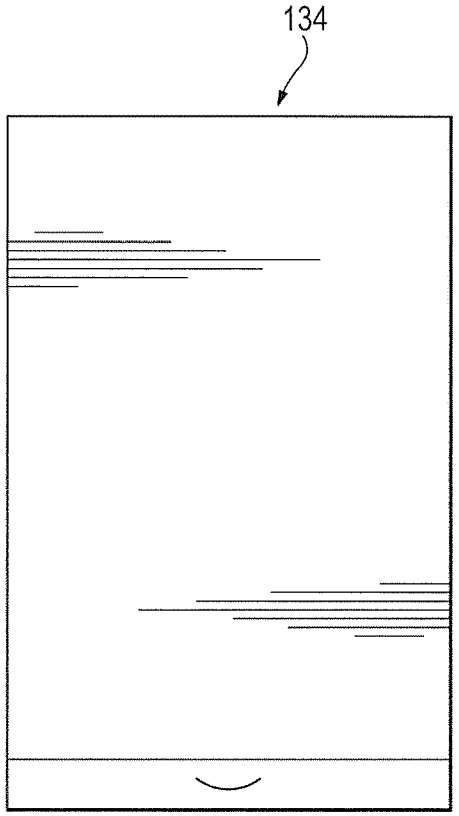
Figure 23:
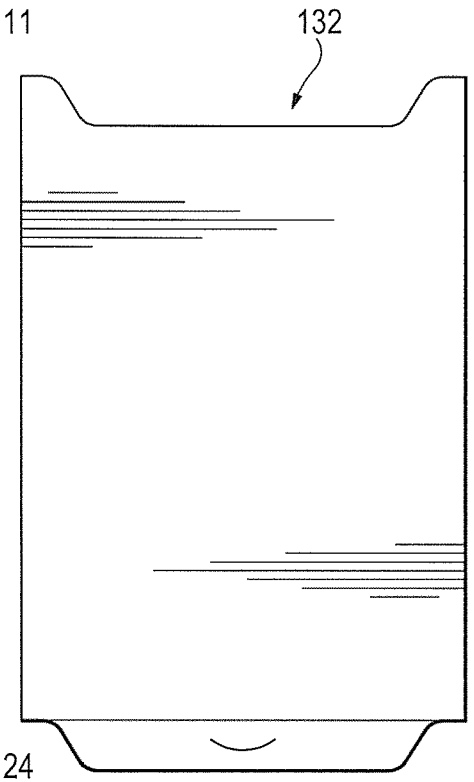

FIG. 23-25 show variations on the handle seal. FIG. 23 shows a tie flap bag 132 where the bottom portion of the back between the handle seal and the bottom seal has been sculpted to form the ties for the next bag. FIG. 24 shows a straight seal for the handle seal, in which the handle seal parallels the bottom seal, forming a rectangular handle body. FIG. 25 shows a star seal, or folded bag, as shown and discussed in FIGS. 17 and 18.

In this manner, an ergonomic and more efficient bag is provided. The addition of the second handle is relatively easy and inexpensive to achieve. The second handle allows the bags to be filled more to their capacity, but allows users to move the bags more easily. As shown in FIGS. 13 and 15, the formation of the bags may be configured to form the handle ties of the next bag from the areas around the bottom handle of the previous bag. This type of fitting together of one bag with the next is referred to here as tessellation or tessellated manufacture.

Thus, although there has been described to this point a particular embodiment for a bag with a secondary handle, it is not intended that such specific references be considered as limitations upon the scope of the below claims.

What is claimed is:

1. A method of manufacturing, from tubular plastic film, a bag having a bottom handle, the method comprising:

folding the film to form multiple layers that divide full width of the bag into substantially equivalent fractional widths;

forming an open top for the bag by transverse cut across the film;

forming a bottom seal for the bag by heat-sealing the multiple layers of film at an end longitudinally opposite the open top;

forming a handle seal for the bag by heat-sealing the film at least partially across a transverse width of the film between the bottom seal and the open top, thereby defining a handle body between the handle seal and the bottom seal; and forming a handle hole in the handle body by cut-sealing a handle shape through the layers to seal the perimeter of the handle hole.

2. The method of claim 1, wherein forming the handle hole comprises forming a curved slit that is initially closed.

3. The method of claim 1, wherein the handle shape comprises a curved slit.

4. The method of claim 1, wherein forming the handle seal further comprises fusing completely together the layers of film between the handle seal and the bottom seal that comprise the handle body.

5. The method of claim 4 wherein the cut-sealed handle shape comprises a semicircular slit oriented concave-up with respect to the open top and the bottom seal.

* * * * *